US008840841B2

(12) United States Patent
Roberts

(10) Patent No.: US 8,840,841 B2
(45) Date of Patent: Sep. 23, 2014

(54) BREATHING AIR PRODUCTION AND DISTRIBUTION SYSTEM

(75) Inventor: Rick Roberts, Deer Park, TX (US)

(73) Assignee: Total Safety US, Inc., Houston, TX (US)

( * ) Notice: Subject to any disclaimer, the term of this patent is extended or adjusted under 35 U.S.C. 154(b) by 35 days.

(21) Appl. No.: 13/277,036

(22) Filed: Oct. 19, 2011

(65) Prior Publication Data

US 2012/0266889 A1 Oct. 25, 2012

Related U.S. Application Data

(60) Provisional application No. 61/394,703, filed on Oct. 19, 2010.

(51) Int. Cl.

| | |
|---|---|
| ***A62B 7/08*** | (2006.01) |
| ***A62B 7/10*** | (2006.01) |
| ***F24F 3/16*** | (2006.01) |
| ***A62B 15/00*** | (2006.01) |
| ***A62B 29/00*** | (2006.01) |

(52) U.S. Cl.

CPC ..... *A62B 15/00* (2013.01); *F24F 3/1603* (2013.01); *A62B 29/00* (2013.01)

USPC ..... 422/122; 128/205.27; 128/200.24

(58) Field of Classification Search

USPC ..... 128/205.27, 200.24; 422/122

See application file for complete search history.

(56) References Cited

U.S. PATENT DOCUMENTS

| | | | | |
|---|---|---|---|---|
| 4,510,930 | A | 4/1985 | Garcia | |
| 4,670,223 | A * | 6/1987 | Delachapelle | 96/130 |
| 4,862,931 | A | 9/1989 | Vella | |
| 4,870,961 | A | 10/1989 | Barnard | |
| 7,347,204 | B1 | 3/2008 | Lindsey et al. | |
| 7,647,927 | B2 | 1/2010 | Teetzel et al. | |
| 8,048,391 | B2 * | 11/2011 | Molins | 423/210 |
| 2003/0182900 | A1 | 10/2003 | Bowden et al. | |
| 2009/0004047 | A1 * | 1/2009 | Hunter et al. | 422/4 |
| 2009/0115604 | A1 | 5/2009 | Thomas et al. | |
| 2009/0133730 | A1 | 5/2009 | McVey | |
| 2010/0032040 | A1 * | 2/2010 | Turiello | 137/861 |

OTHER PUBLICATIONS

International Search Report for counterpart International Appl. No. PCT/US2011/056927, dated Jan. 24, 2012.

(Continued)

*Primary Examiner* — Kevin Joyner

(74) *Attorney, Agent, or Firm* — Wong, Cabello, Lutsch, Rutherford & Brucculeri, LLP

(57) ABSTRACT

A breathing air production and filtration system has an air generation assembly and a distribution assembly. The generation assembly has a compressor and filtration components to generate breathing air. The distribution assembly has collection pots with multiple connections for manifolds. For their part, the manifolds have multiple connectors for the respirators of end users. The system uses a monitoring control system with various wireless sensors to monitor operation of the system and the quality of breathing air produced. These sensors include an in-line sensor detecting constituents or contaminants in the breathing air. The sensors also include pressure, temperature, and flow sensors monitoring the operation of the system. An automatic switchover is provided for switching the system to a back-up supply of high-pressure reserve air if needed.

45 Claims, 12 Drawing Sheets

(56) References Cited

OTHER PUBLICATIONS

Written Opinion for counterpart International Appl. No. PCT/US2011/056927, dated Jan. 24, 2012.

Total Safety, "Respiratory Equipment: Air Cobra Breathing Air System," obtained from http://www.totalsafety.com, generated Sep. 27, 2010, undated.

Total Safety, "Air Cobra(TM)," obtained from http://www.totalsafety.com/brochures-pdf/air_cobra.pdf, accessed Oct. 19, 2011, undated.

Total Safety, "Breathing Air: HPLS Services," obtained from http://www.totalsafety.com/brochures-pdf/hpls%20services.pdf, accessed Oct. 19, 2011, undated.

Total Safety, "2009-2010 Total Safety Products & Services Catalog: Respiratory Equipment," pp. 1-54, obtained from http://www.totalsafety.com/catalog/Respiratory_Equipment.pdf, accessed Oct. 19, 2011, undated.

Total Safety, "2009-2010 Total Safety Products & Services Catalog: Respiratory Equipment," pp. 55-108, obtained from http://www.totalsafety.com/catalog/Respiratory_Equipment.pdf, accessed Oct. 19, 2011, undated.

* cited by examiner

BREATHING AIR PRODUCTION AND DISTRIBUTION SYSTEM

CROSS-REFERENCE TO RELATED APPLICATIONS

This is a non-provisional of U.S. Provisional Pat. Appl. No. 61/394,703, filed 19 Oct. 2010, which is incorporated herein by reference and to which priority is claimed.

FIELD OF THE DISCLOSURE

Embodiments of the present disclosure relate to an air breathing system usable in a chemical plant, refinery, or other facility where workers need to breathe good quality air while working in a harsh environment.

BACKGROUND OF THE DISCLOSURE

People in industrialized nations spend more than 90% of their time indoors, and many industry-related occupations require personnel to work in conditions having airborne pollutants. The lung is the most common site of injury by airborne pollutants. Acute effects from airborne pollutants may also include non-respiratory signs and symptoms, which may depend upon toxicological characteristics of the substances involved.

To improve air quality, facilities use ventilation systems, which vary as to design, use, specifications, and maintenance. Most ventilation systems restrict the movement of air in and between various departments, and the systems may have specific ventilation and filtration capabilities to dilute and remove contamination, airborne microorganisms, viruses, hazardous chemicals, radioactive substances, and the like.

In addition to ventilation systems, some work environments can have hazards, and personnel need uncontaminated breathing air supplied to them while working in the hazardous environments. For example, various chemicals used in industrial processes are known to be hazardous to people in and around a work environment if the chemicals are not handled or ventilated properly. Vaporous chemicals, such as acetic acid, benzene, formaldehyde, nitrous oxide, and xylene, carry health warnings and can often affect a person's immune system if the person is exposed to the chemical.

In addition, situations arise in which volatile, toxic, and particulate laden gasses may be generated or leak into an interior room of a building or other confined space—potentially exposing personnel to hazards. Personnel in work environments may also be exposed to the presence of gasses, such as vapors from hydrocarbon based products as well as natural or liquefied petroleum gasses within an enclosure or confined space, such as an interior room of a building. In some cases, hazardous materials, such as volatile organic compounds, cannot be vented from an interior space to the atmosphere. Some examples of these volatile organic compounds include automobile and aircraft paints, resurfacing materials, porcelain paints, reducers, glues, cleaning agents, grain dust, and hydrocarbon fumes. These materials must be carefully evacuated from the interior space to avoid adverse effects, including unwanted combustion of such materials.

Accordingly, there has always been a need to produce and filter breathing air for personnel working in a variety conditions and potentially exposed to hazards. The subject matter of the present disclosure is directed to addressing this need.

SUMMARY OF THE DISCLOSURE

A breathing air production and filtration system has an air generation assembly and a distribution assembly. The generation assembly has a compressor and filtration components to generate breathing air. The distribution assembly has collection pots with multiple connections for manifolds. For their part, the manifolds have multiple connectors for the respirators of end users. The system uses a monitoring control system with various wireless sensors to monitor operation of the system and the quality of breathing air produced. These sensors include an in-line sensor detecting constituents or contaminants in the breathing air. The sensors also include pressure, temperature, and flow sensors monitoring the operation of the system. An automatic switchover is provided for switching the system to a back-up supply of high-pressure reserve air if needed.

The foregoing summary is not intended to summarize each potential embodiment or every aspect of the present disclosure.

DETAILED DESCRIPTION OF THE DISCLOSURE

A. First Embodiment of Breathing Air Production and Filtration System

Figure 1:
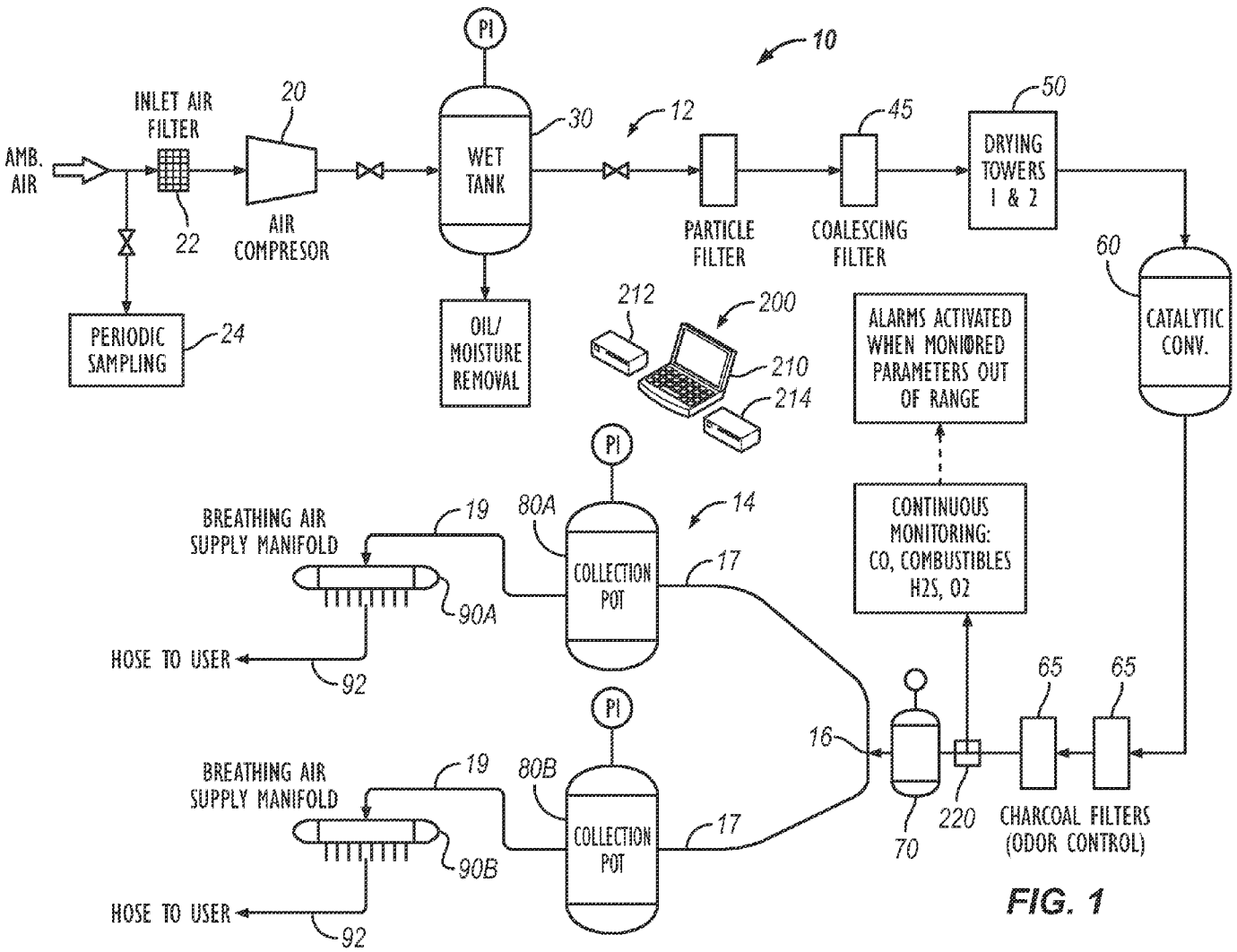
FIG. 1 illustrates a breathing air production and filtration system according to the present disclosure.

FIG. 1 illustrates a system 10 according to the present disclosure for producing filtered breathing air and delivering the breathing air to end users in a work environment. The system 10 has a generation assembly 12 that generates the breathing air from ambient air in a remote environment. To do this, the generation assembly 12 includes a compressor 20, a wet tank 30, a particle filter 40, a coalescing filter 45, drying towers 50, a catalytic converter 60, charcoal filters 65, and a dry tank 70. All of these components of the generation assembly 12 can be mounted on a skid or trailer, which can be positioned far from work areas.

A second part of the system 10 includes a distribution assembly 14 in communication with the generation assembly 12. The distribution assembly 14 receives the generated breathing air from the generation assembly 12 and delivers it to the end users located in work areas of a potentially hazardous environment. To deliver the air, the distribution assembly 14 has one or more tanks or collection pots 80A-B and one or more distribution manifolds 90, which can be placed in various work areas.

Finally, the system 10 also includes a monitoring control system 200, which monitors and controls the system 10 using various sensors and communication links to be described in more detail later. Overall, the monitoring control system 200 can verify that clean breathing air is produced on-site. For example, the system 200 can monitor samples of the breathing air in real time and can test parameters of the sampled breathing air, such as contaminant content, pressure, temperature, quality, etc., to verify the proper production and delivery of the breathing air.

As hinted above, overall operation of the system 10 begins with the generation assembly 12 generating the breathing air. The system 10 typically uses a single generation assembly 12 as described, although additional generation assemblies 12 can be connected to the system 10 to increase the volume of air provided, if necessary. However, for purposes of the present disclosure, reference is made to a single generation assembly 12.

In the generation assembly 12, the compressor 20 compresses the ambient air in the remote environment. Any suitable type of compressor 20 can be used. As it operates, the compressor 12 takes in the ambient air through an inlet filter 22 and compresses the air to a desired pressure. From the compressor 20, the compressed air passes through the assembly's other components (e.g., wet tank 30, particle filter 40, coalescing filter 45, drying towers 50, catalytic converter 60, charcoal filters 65, and dry tank 70), which provide air filtration and purification. For example, the assembly's filtration capabilities can be designed to filter out particle contaminants, moisture (water), oil vapor carryover, and carbon monoxide (CO) so that the generated breathing air will be of high quality. Other gases and hydrocarbons can be adsorbed as well. After generating the breathing air, the assembly 12 in one implementation can provide 200 actual cubic feet per minute (acfm) of breathing quality air at 125-psig at its outlet (i.e., at the discharge of the dry tank 70).

After being compressed, filtered, and the like, the breathing air passes to the distribution assembly 14 to be distributed to the end users in the work areas. To communicate the breathing air, the distribution assembly 14 uses an arrangement of various air hoses 17, 19, and 92 of different diameters (e.g., 2-inch, ¾-inch, and ⅜-inch diameters) between the assembly's components (i.e., pots 80A-B and manifolds 90A-B). When the system 10 is installed at a worksite, for example, the collection pots 80A-B are usually situated in the work areas away from the generation assembly 12 and connected to it by a 2-inch diameter hose 17.

In the distribution assembly 14, the collection pots 80A-B can use a tank similar to the dry tank 70. In some implementations, the distribution assembly 14 can use one or more collection pots 80A-B depending on the relative locations where the breathing air is needed. Each collection pot 80A-B provides air-volume surge capacity in the system 10 and gives a dampening effect on the supplied air stream. This helps the distribution assembly 12 maintain a consistent flow and pressure of breathing air to the end users.

The arrangement between generation assembly 12 and the collection pots 80A-B depends on the number of collection pots 80A-B deployed and the connection network between them. Each collection pot 80A-B can have as many as thirty (30) discharge outlets. Each of the outlets can be a ¾-in. connection and can connect to one of the distribution manifolds 90 via a ¾-in. hose 19.

For their part, the distribution manifolds 90 provide hose connections to individual end users using the outlets (e.g., eight ⅜-in. outlets for hoses 92). The air consumption for each end user (scfm/user) ranges between 4-8 standard cubic feet per minute (scfm) of breathing air. The individual end users are connected by the ⅜-in. hoses 92 from the manifold 90 to their breathing apparatus or respirators (not shown). Typically, a full facemask respirator provides a delivery pressure of 1.5-psig. However, a somewhat higher pressure is preferably delivered to the respirators, and each respirator can have a built-in regulator that drops the air pressure down to the facemask's 1.5-psi level. Thus, in one implementation, the system 10 maintains a pressure of 80-100-psig at the collection pots 80A-80B for the regulators to work properly.

FIG. 1 shows a typical configuration of the system 10 having one generation assembly 12 feeding two collection pots 80A-80B and various connected distribution manifolds 90. The lengths of the connecting hoses 17 and 19 between the generation assembly 12, pots 80A-B, and manifolds 90 depend on the implementation. In general, 2-in. hoses 17 connect the generation assembly 12 to the collection pots 80A-B, and these hoses 17 can range between 200 to 2,000-ft. in length. Hoses 19 of ¾-in. connect between the collection pots 80A-B and distribution manifolds 90, and these hoses 19 can be up to 200-ft. Finally, hoses 92 of ⅜-in. connect between the individual end user connection and the manifold 90, and these hoses 92 can be up to 300-ft. long.

As discussed above, the system 10 uses the monitoring control system 200 to monitor and control the system 10 using various sensors and communication links to be described in more detail later. The monitoring control system 200 includes a control unit 210, which can be a computer or the like. The control unit 210 has a storage device 212 and a communication interface 214. The storage device 212 can be any suitable device for storing monitored parameters for the system 10. The communication interface 214 can use a wired and/or wireless network to communicate with various sensors, alarms, solenoids, actuators, and other components of the disclosed system 10. Preferably, those components intended to be separate from the skid holding the generation assembly 12 use wireless communications with the control unit 210.

As part of the monitoring control system 200, an in-line sensor 220 is disposed in communication with the breathing air from the generation assembly 12 before delivery to the collection pots 80A-B. As it operates, the in-line sensor 220 continuously monitors the breathing air for constituents and contaminants, such as $O_2$, $CO_2$, CO, combustibles, $H_2S$, oil mist, and the like. Then, the in-line sensor 220 operatively communicates readings with the control unit 210 through a wired or wireless connection so the control unit 210 can record appropriate readings and can take certain actions during an event. The monitoring control system 200 can also monitor the ambient air coming into the intake of the system 10 using periodic sampling with a sensor 24 to check the initial quality of the ambient air used to generate the breathing air.

B. Skid for Generation Assembly of Disclosed System

Figure 2:
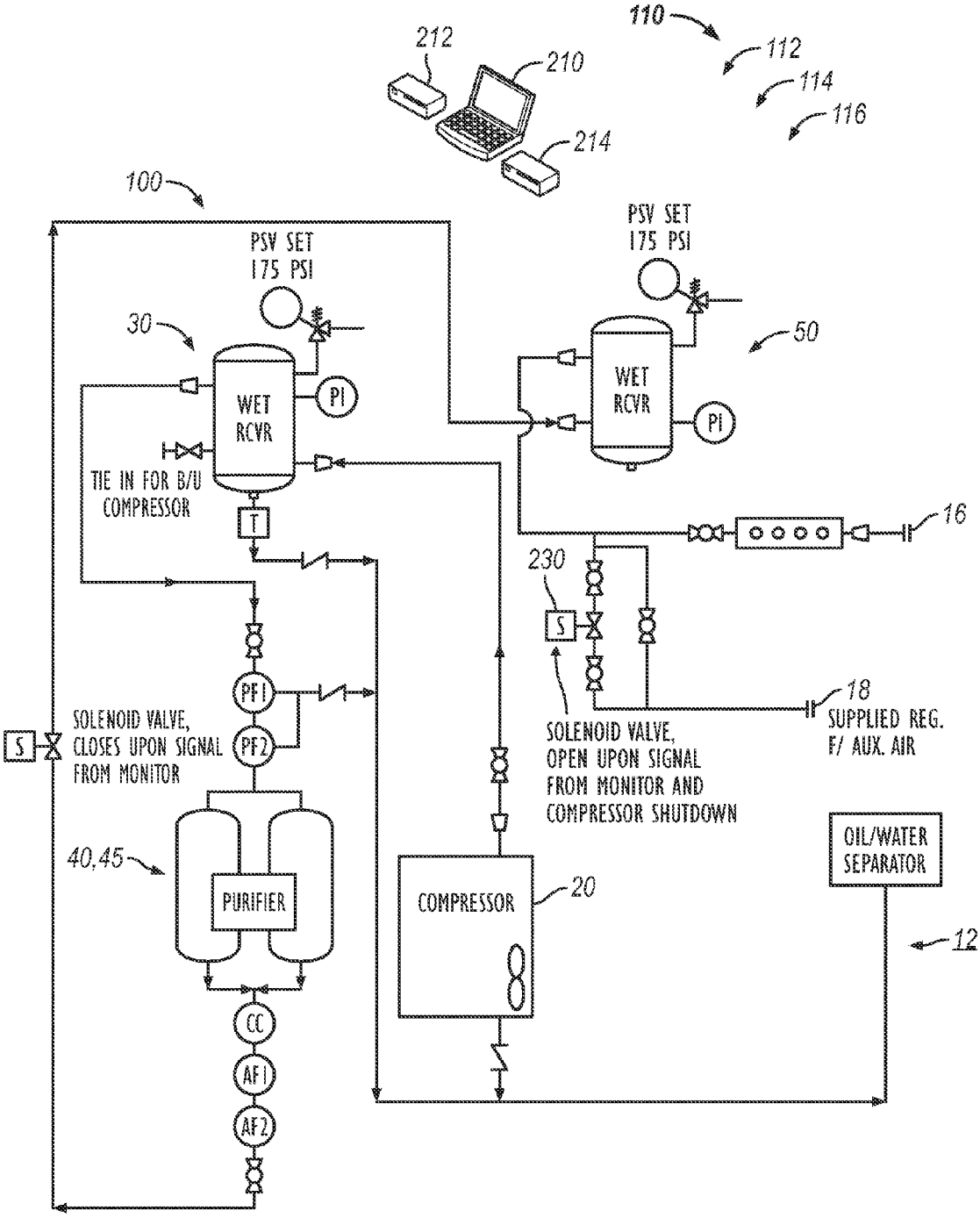
FIG. 2 illustrates a schematic of a skid for the disclosed system.
Figure 3:
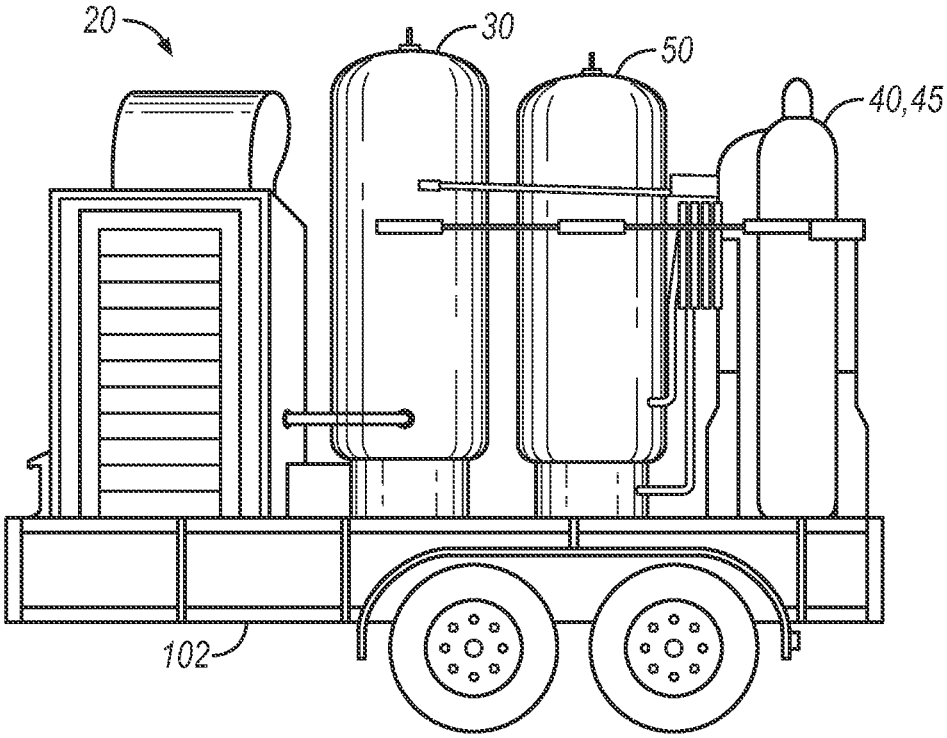
FIG. 3 shows an example of a skid for the disclosed system.

As mentioned above, components of the generation assembly 12 can be mounted on a skid or trailer, which can be remotely located from work areas. To that end, FIG. 2 illustrates a schematic of a skid 100 for the disclosed system 10, and FIG. 3 shows an example of the skid 100 mounted on a trailer 102. The skid 100 holds the compressor 20, the wet tank 30, the particle filter 40, the coalescing filter 45, and the dry tank 70, among other components of the generation assembly 12. The monitoring control system 200 is either integrated into or associated with the skid 100.

The wet tank 30 can have a tie-in connection for a backup compressor to connect thereto, should the main compressor 20 fail. To deliver the breathing air, the skid 100 has a discharge connection 16, which can be a 2-inch crow's foot connector for connecting the generation assembly 12 to components of the distribution assembly (14; FIG. 1) described herein. The actual worksite can be from 100 feet to ¼ mile away from the skid 100, and the outlet pressure of the generation assembly 12 is preferably 110 to 125 psi.

The skid 100 can also have an inlet connection 18 for connecting to a regulator and auxiliary air supply. For example, this inlet connection 18 can connect to a reserve supply of high-pressure breathing air on a tube trailer or the like—an example of which is described later. A controllable switch-over 230 having a solenoid valve interconnects the auxiliary connection 18 to the skid's outlet. Further details of the reserve supply and the switch-over 230 as well as how the monitoring control system 200 uses them will be described later.

The power supply 110 to the components of the skid 100 is preferably divided into three subsystems. A first power subsystem 112 supplies power to the compressor 20, which can be a twin-screw compressor with an electric motor. If the compressor 20 fails or its power supply is compromised, other components detailed below can remain powered improving operation of the assembly 12.

In particular, a second power subsystem 114 supplies power to the filtration components of the skid 100, and a third power subsystem 116 supplies power to the detection components on the skid 100. These detection components include gas detection sensors, pressure sensors, and the like described in more detail herein that are used to monitor and detect issues with the air supply being generated. Having the power supply 110 divided in this way is advantageous to the assembly's operation when one or more of the components, compressor 20, etc. fail and back-up compressors or the like need to be connected to the skid 100.

C. Second Embodiment of Breathing Air Production and Filtration System

Figure 4A:
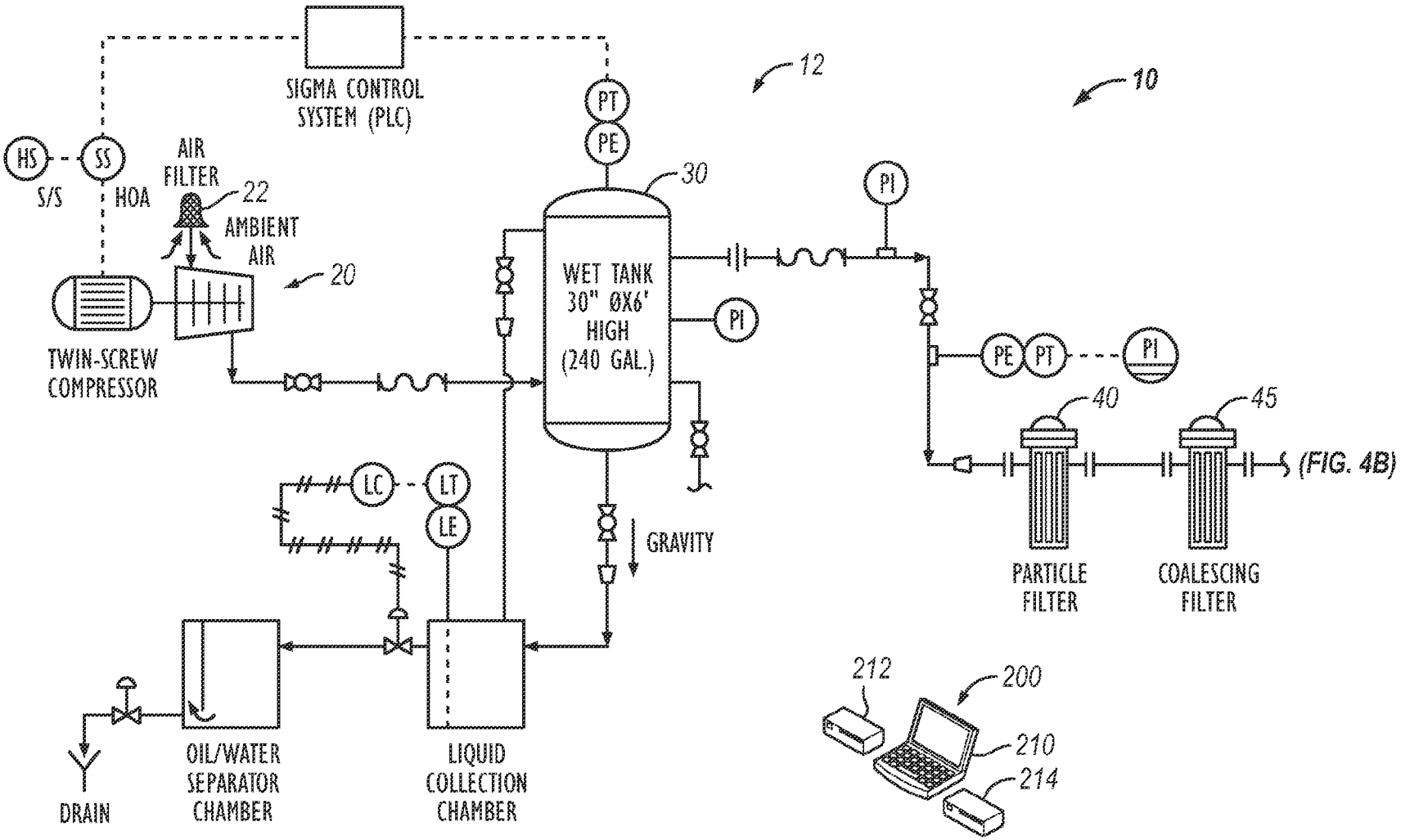
FIGS. 4A-4C illustrate another arrangement of a breathing air production and filtration system according to the present disclosure.
Figure 4B:
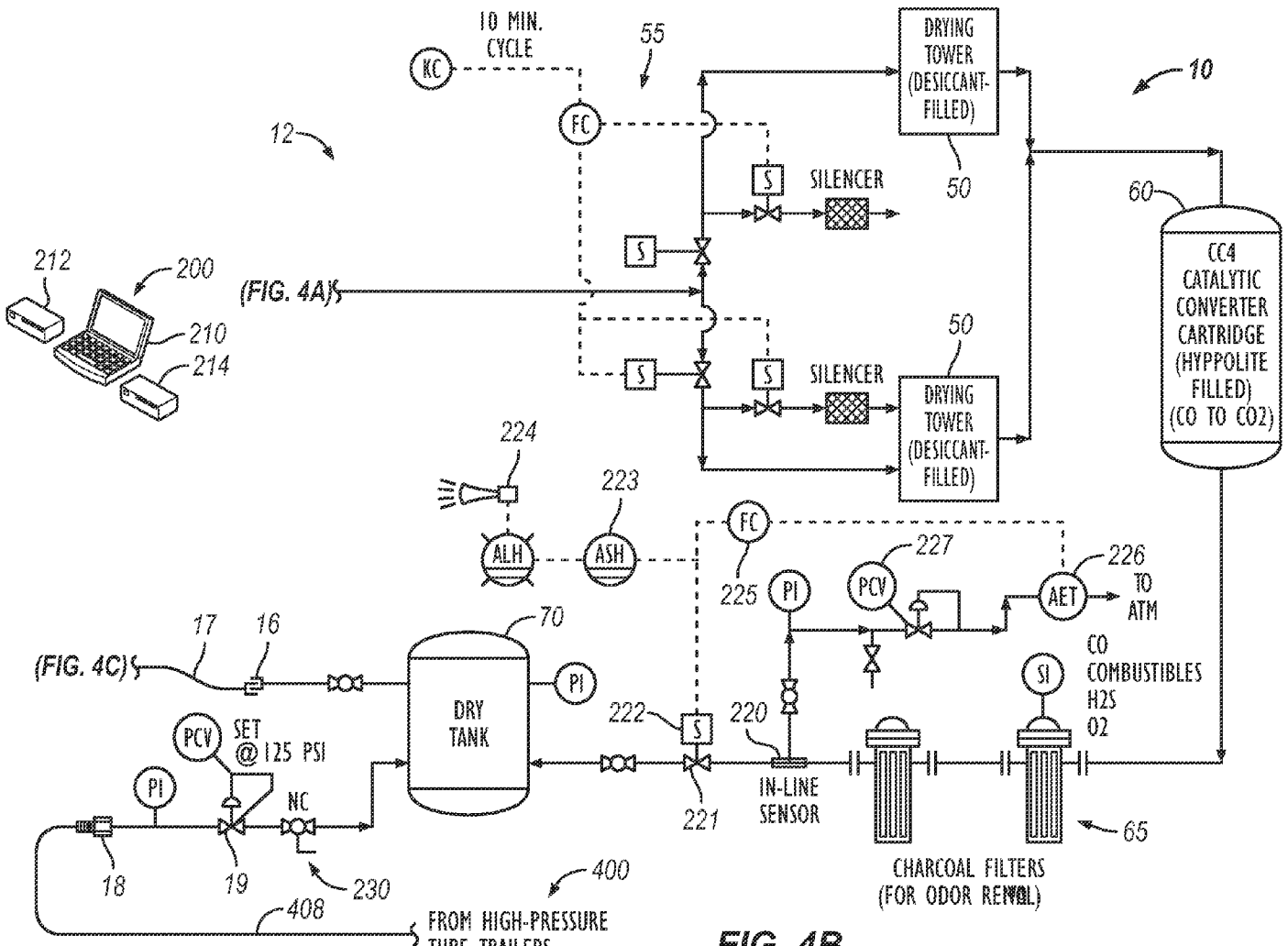
Figure 4C:
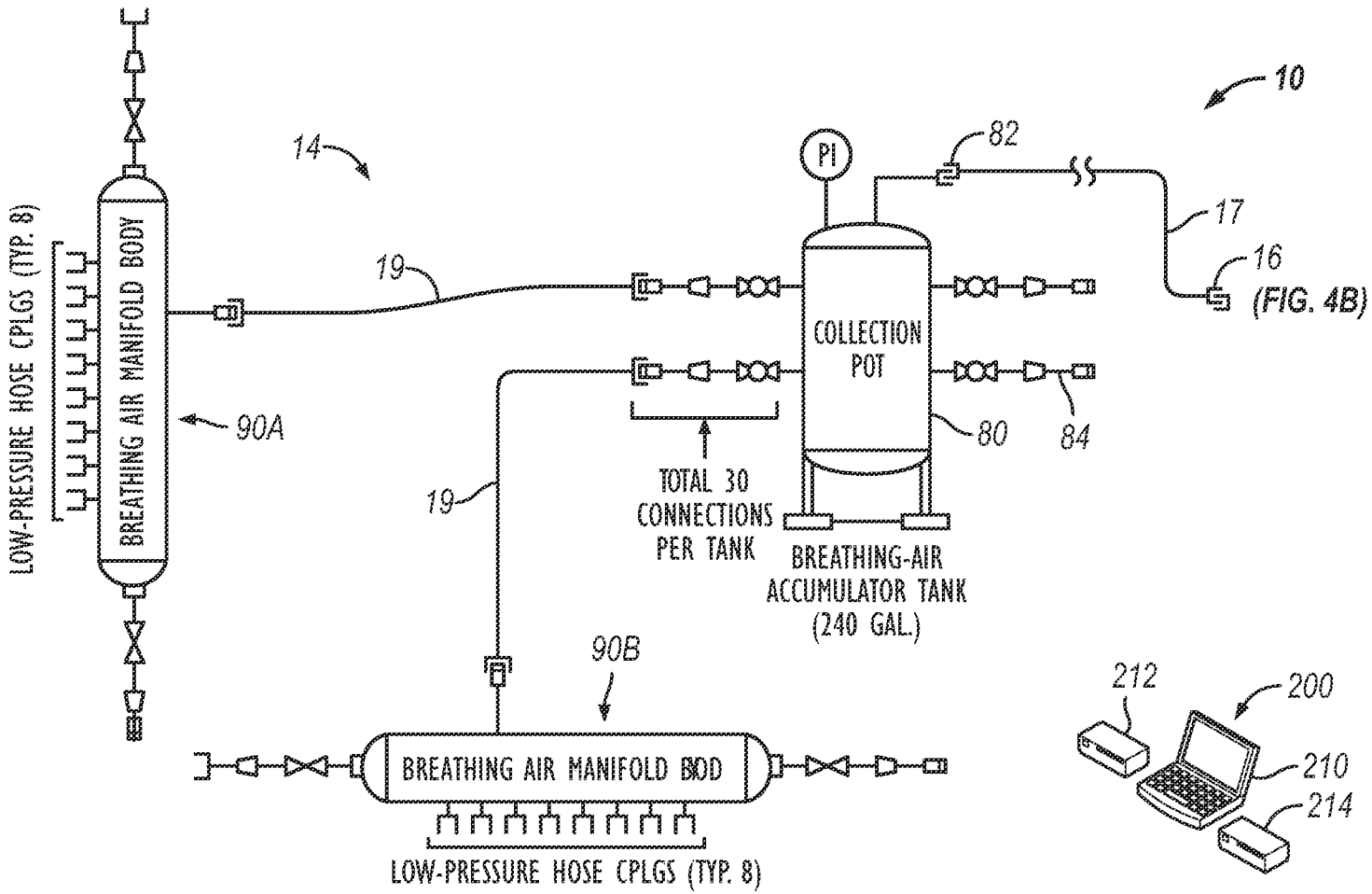

FIGS. 4A-4C illustrate another arrangement of a breathing air production and filtration system 10 according to the present disclosure. As before, the system 10 has a breathing air generation assembly 12 (FIGS. 4A-4B) and a distribution assembly 14 (FIG. 4C). As noted before, the generation assembly 12 generates the breathing air and can be mounted on a skid or trailer. A discharge outlet 16 on the generation assembly 12 (FIG. 4B) can connect to a large hose 17 for communicating with the distribution assembly 14 (FIG. 4C). In general, this connection at the outlet 16 can be a 2-in. crow's foot connector.

As shown in FIGS. 4A-4B, the generation assembly 12 has a compressor 20, a wet tank 30, a particle filter 40, a coalescing filter 45, drying towers 50, a catalytic converter 60, charcoal filters 65, and a dry tank 70. A drying control 55 can be provided for the drying towers 50 to route generated breathing air to the towers 50 on an alternating basis.

As shown in FIG. 4C, the distribution assembly 14 connects to the generation assembly 12 with a large hose 17 extending from the connector 16. The distribution assembly 14 delivers the breathing air to the end users at the various work areas. In this arrangement, the distribution assembly 14 has a single collection pot 80 and one or more distribution manifolds 90.

As shown in FIGS. 4A-4C, the wet tank 30, dry tank 70, and collection pot 80 can each have a capacity of 240 gallons. The catalytic converter 60 can be filled with hyppolite and can convert carbon monoxide (CO) to carbon dioxide ($CO_2$).

The system 10 also includes the monitoring control system 200, which monitors and controls the system 10. Again, an in-line sensor 220 continuously monitors for constituents of the breathing air (e.g., oxygen percentage, carbon dioxide part-per-million, etc.) and monitors for contaminants, such as CO, $H_2S$, combustibles, oil mist, and/or other undesirable contaminants. The constituents being monitored and the acceptable levels of each depend on the desired air quality standard being used.

A preferred in-line sensor 220 for the system 10 includes a photoionization detector (PID) and a wireless modem (transmitter) so the sensor 220 can provide real-time gas measurements of volatile organic compounds of interest to the control unit 210. Measurements for other substances, such as hydrogen sulfide, chlorine, oxygen, carbon dioxide or the like, can be tested with additional sensor elements. One suitable example for the in-line sensor 220 includes an AreaRAE gas monitor, such as the AreaRAE Steel Gas Monitor or MuIti-RAE Plus Gas Detector from RAE Systems, of San Jose, Calif. The preferred gas monitor has instrumentation for in-line monitoring in an air stream of the disclosed generation assembly 12.

The in-line sensor 220 operatively communicates with a flow controller 225. In turn, the flow controller 225 connects to an analyzer switch 223 of an alarm 224 and connects to a solenoid 222 for a gate valve 221. If a contaminant is detected with the in-line sensor 220, for example, the flow controller 225 shuts off air flow from the generation assembly 12 using the solenoid 222 and gate valve 221. The flow controller 225 can also activate the alarm 224 whenever any of the monitored parameters goes out of range.

When operated by the solenoid 222, the closed gate valve 221 closes off communication of the generated breathing air to the dry tank 70. Instead, the air can be routed to a pressure control valve 227 and vented to atmosphere if needed. The flow controller 225 can also be coupled to an alarm element transmitter 226 that can connect to the control unit 210 using either a wired or a wireless connection. The control unit 210 can store details of alarm conditions in its storage device 212 for later retrieval and analysis, which may be useful in resolving issues with the system 10, its operation, its placement, etc.

The system 10 provides back-up breathing air should operation of the generation assembly 12 fail or a contaminant is detected. For this purpose, the system 10 couples to a reserve air supply 400, which can be a high-pressure tube trailer as disclosed below with reference to FIG. 8. As shown, the reserve air supply 400 connects by a high-pressure hose 408 to the dry tank 70. A pressure control valve 232 set at 125 psi and a controllable switch-over 230 connect in line with the reserve air supply 400. If the compressor 20 fails or if some other problem arises, then the control unit 210 activates the controllable switch-over 230 to supply high-pressure air from the reserve supply 400 to the dry tank 70 for the system 10. This reserve supply 400 can then be used temporarily until a new compressor is connected or a backup compressor is activated, at which point the controllable switchover 230 can be deactivated.

D. Third Embodiment of Breathing Air Production and Filtration System

Figure 5A:
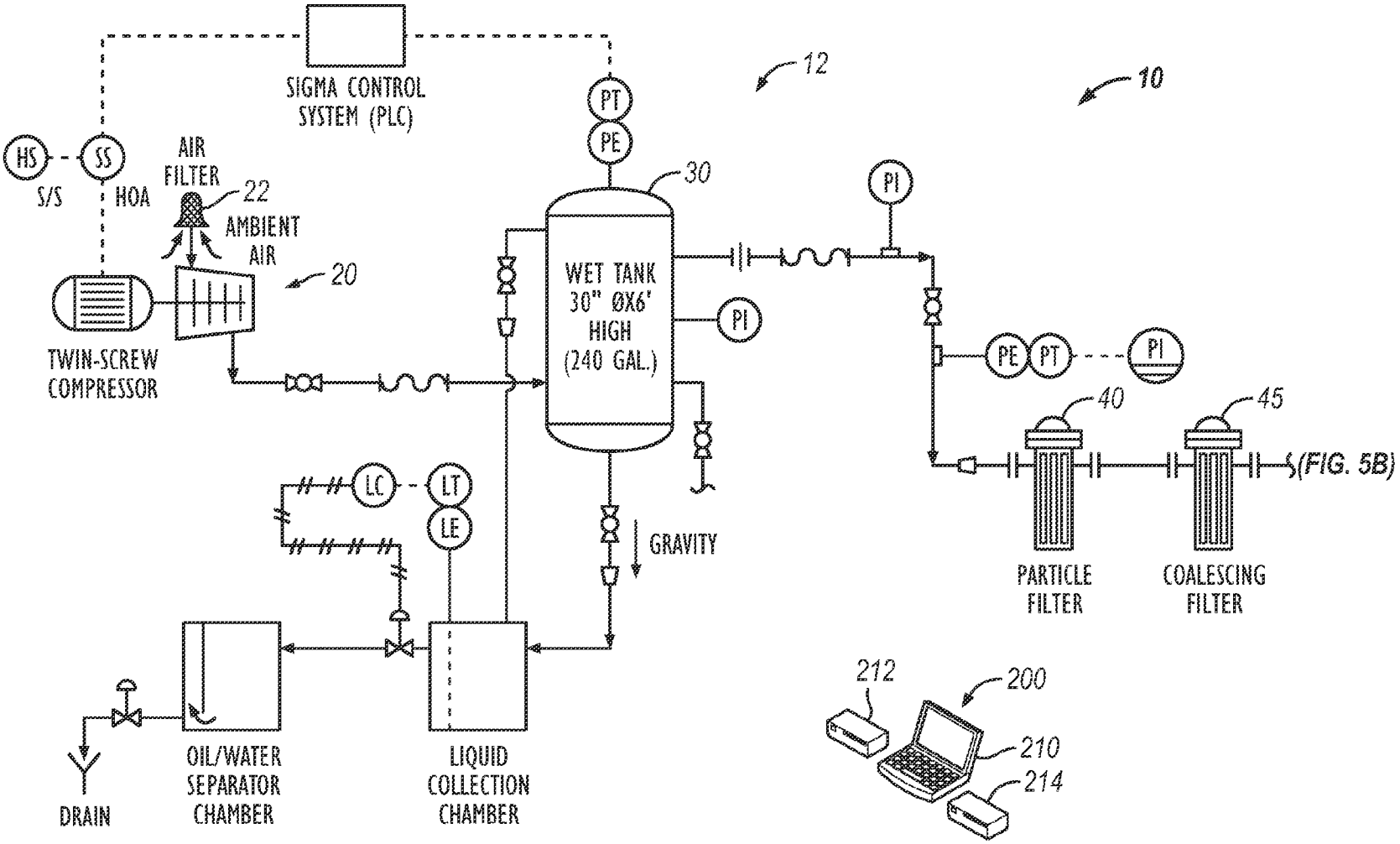
FIGS. 5A-5C illustrate yet another arrangement of a breathing air production and filtration system according to the present disclosure.
Figure 5B:
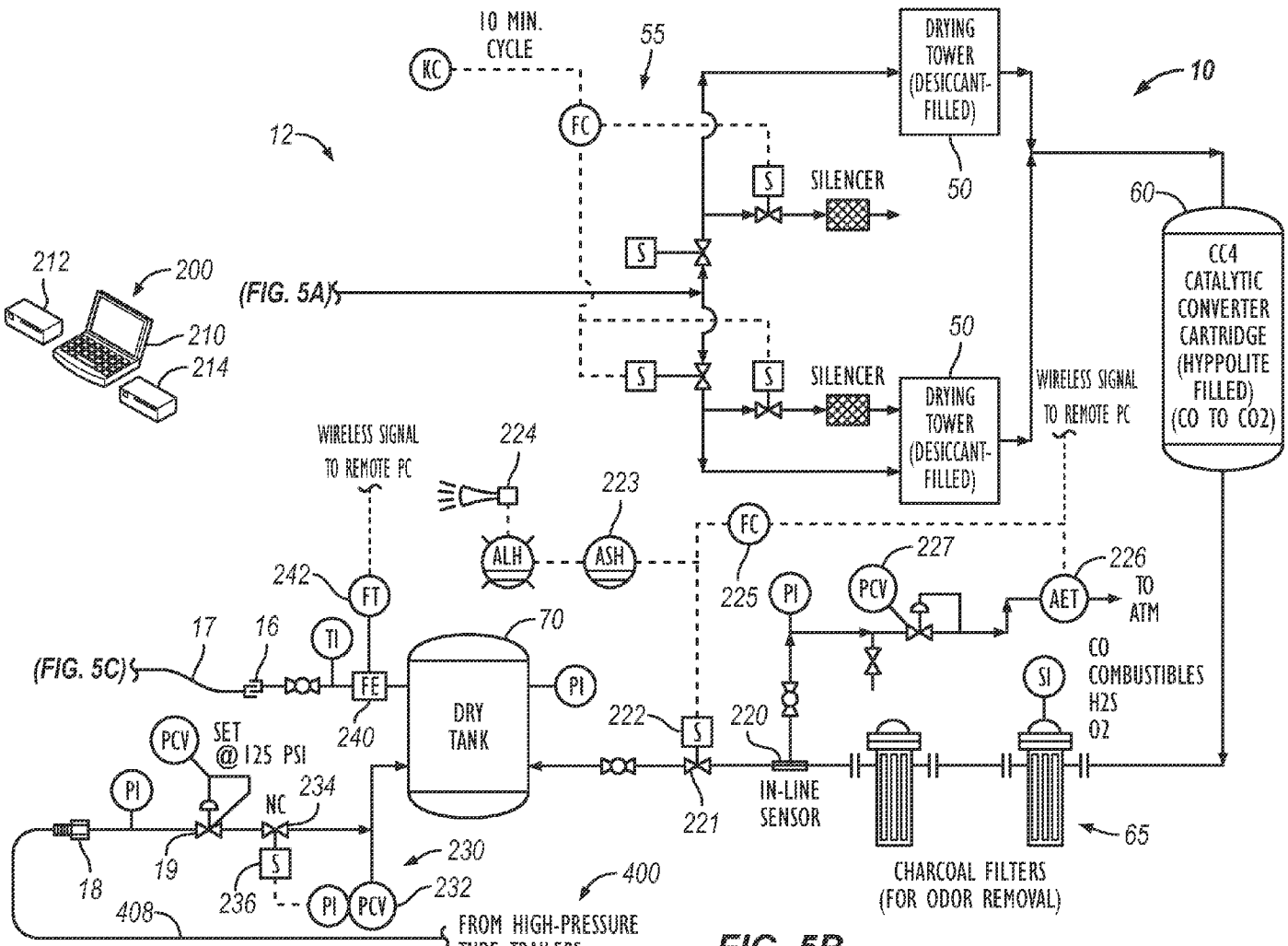
Figure 5C:
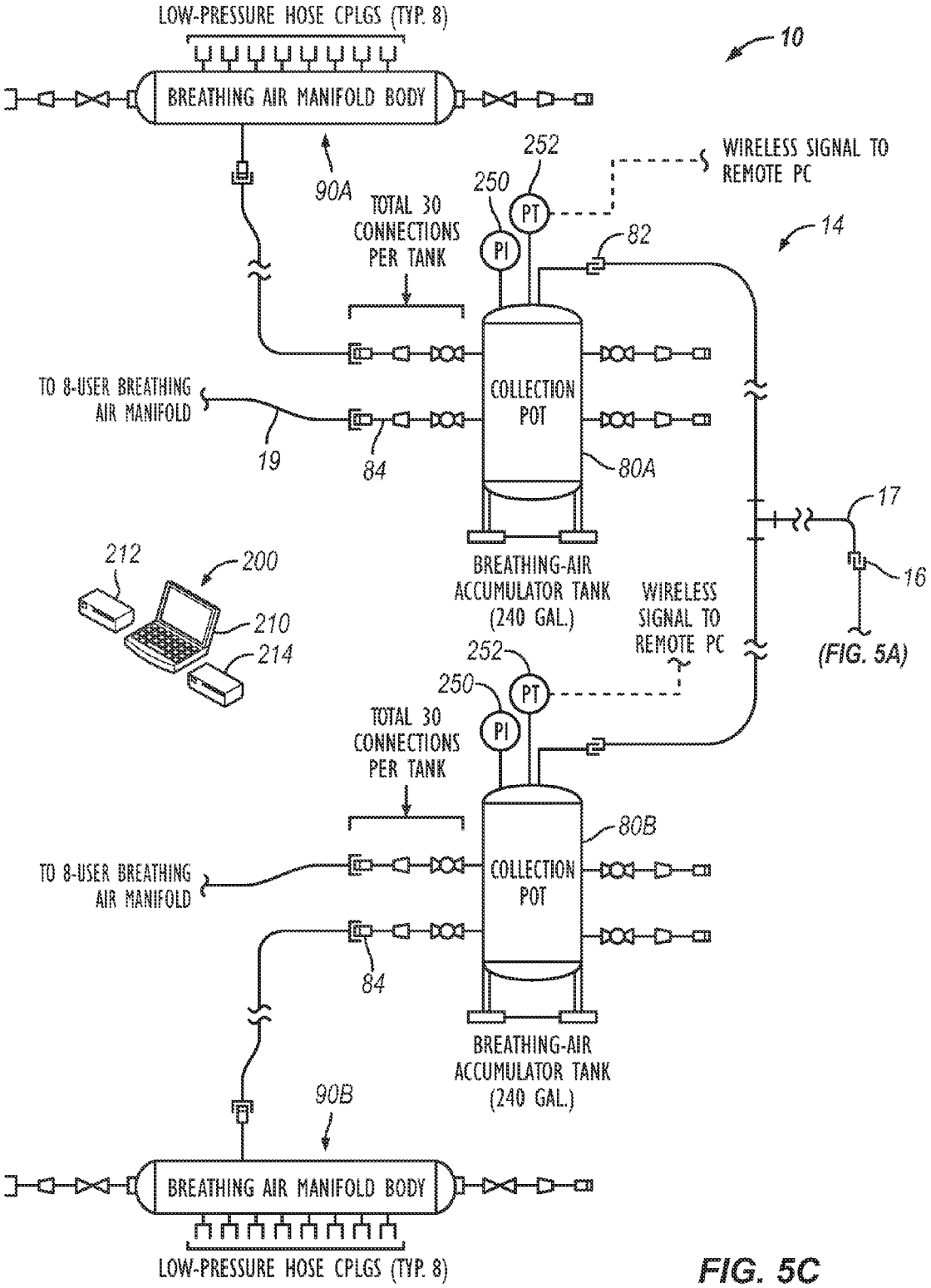

FIGS. 5A-5C illustrate yet another arrangement of the disclosed system 10. This arrangement is similar to that described above in FIGS. 4A-4C. Here, the system 10 has two collection pots 80A-B as well as additional sensing features for the monitoring and control system 200. In particular, the alarm element transmitter 226 coupled to the flow controller 225 sends a wireless signal to the control unit 210 via a suitable wireless connection, although a wired connection could be used. The information communicated can be used by the control unit 210 for data logging and storage in the storage device 212. This can be beneficial in reviewing whether any events with contaminants occurred so issues with the system 10 can be resolved. The wireless signal can also be used by the control unit 210 to activate the automatic switch-over 230 to change to the reserve supply 400 and shut off the breathing air supplied by the generation assembly 12.

Looking at the switch-over 230 in more detail, the reserve air supply 400 connects by a ¼-inch high-pressure hose 408 to a fitting 18 on the generation assembly 12. In turn, piping connecting from this fitting 18 passes a pressure control valve 19 and the switchover 230 before reaching an inlet on the dry tank 70. For its part, the controllable switchover 230 is shown having a pressure sensor 232, a controllable gate valve 234, and an actuator (e.g., solenoid) 236. The switch-over 230 can be activated to feed air from the reserve supply 400 should the compressor 20 fail, if the pressure supply by the generation assembly 12 fails below a minimum threshold, if a contaminant is detected, or if any other suitable reason warrants. For example, if the pressure of the generation assembly 12 as measured by the pressure sensor 232 off the dry tank 70 falls below 80-psi, then the solenoid 236 is activated to open flow through the gate valve 234 so back-up air can be supplied to the dry tank 70. The pressure control valve 19 is preferably set to 125 psi to control the supply of air into the generation assembly 12 during backup operations.

Connected from the dry tank 70, the monitoring control system 200 includes a flow meter 240 and a transmitter 242 for sending signals to the control unit 210 via an appropriate interface. The information from the flow meter 240 indicates the flow produced by the generation assembly 12 being discharged from the dry tank 70 to the distribution assembly 14 in FIG. 5C. The control unit 210 can log this information in storage 212 and can alter operation of other components of the system 10 to deal with an undesirable, low flow level being discharged.

As best shown in FIG. 5C, the monitoring control system 200 includes pressure/temperature sensors 250A-B and transmitters 252 associated with each collection pot 80A-80B. The sensors 250A-B detect the pressure and temperature of the associated collection pot 80A-B and send the information to the control unit 210 via the transmitters 252. This information can be logged in storage for later reporting and can be used by the control unit 210 to change operation of other components of the system 10. For example, the monitoring control system 200 can monitor pressure to determine if operation should be shut down, if switching to back-up air supply should be done, or the like. The monitoring control system 200 can monitor temperature to shutdown the system 10 when the temperature of the breathing air is too high, for example.

Overall, the control unit 210 can log data from the various sensors (e.g., pressure sensors, temperature sensors, flow meter, in-line sensor, etc.) repeatedly over a time interval so the information can be stored for later reporting. This time interval can be about every ten (10) seconds in one implementation to provide comprehensive monitoring and recording. Moreover, as discussed herein, the control unit 210 can use received information to control other components of the system 10, such as switching to reserve supply 400, increasing system pressures, etc., should the monitored sensor data fall outside of a threshold or a range.

E. Distribution Manifold

Figure 6A:
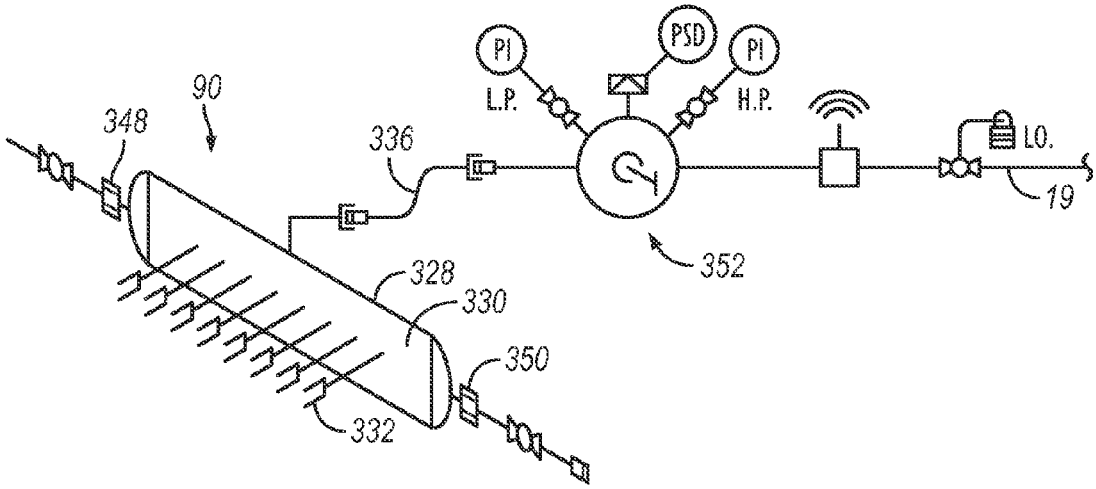
FIGS. 6A-6B illustrate a breathing manifold for the disclosed system.
Figure 6B:
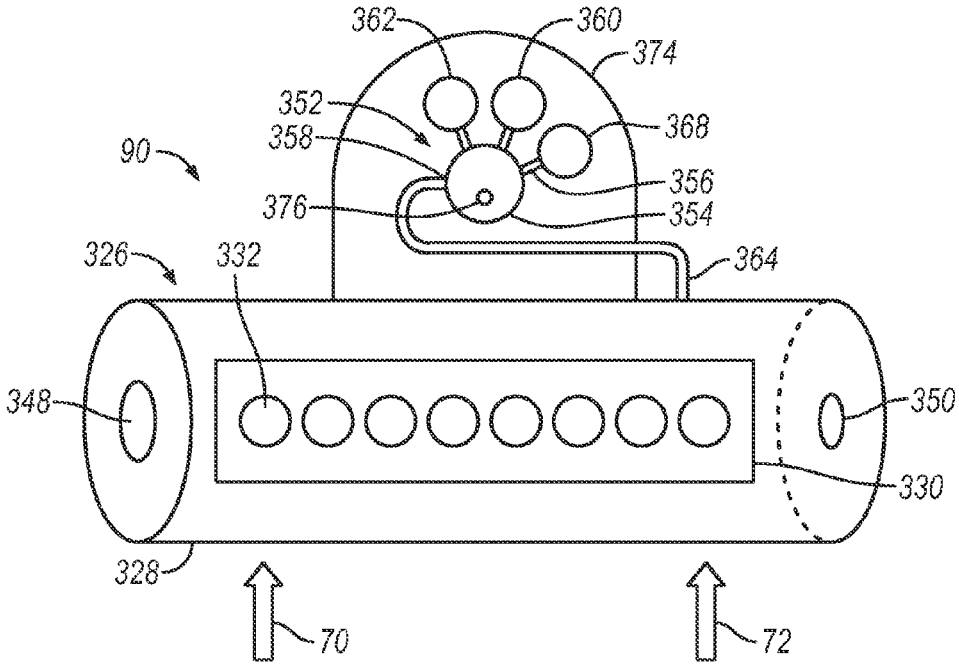

FIGS. 6A-6B illustrate embodiments of a breathing manifold 90 for the disclosed system 10. As noted previously, the disclosed system 10 distributes breathing air to one or more manifolds 90. Preferably, the manifolds 90 can provide at least grade "D" breathing air, as identified by the Compressed Gas Association of the United States. An example of a manifold 90 useable with the system 10 the Killer Bee™ manifold manufactured by Total Safety in Houston, Tex.

The preferred manifold 90 is an eight-way manifold with a pressure regulator and a low-pressure warning alarm preferably mounted on a stand. The manifold 90 facilitates distribution of pressurized air to a lower pressure for breathable air by using at least three (and preferably eight) take-out connections, although more than eight take out connections can be used.

Details of the manifold 90 are shown in FIGS. 6A-6B as well as a regulator 352 usable with the manifold 90 if needed. The manifold 90 has a manifold body 328 that can be between approximately 3-in. and 12-in. long. The manifold 90 is made of stainless steel and has one or more supports (not shown) connected to the manifold body 328.

The manifold body 328 has a chamber 330. Various take-out connections (e.g., 332) are disposed on the manifold body 328. A first plug 348 can be located on one end of the chamber 330, while a second plug 350 can be located on the other end of the chamber 330.

The regulator 352 is in fluid communication with the chamber 330 for receiving the pressurized breathing air and then reducing the pressurized breathing air to a breathable pressure. The regulator 352 can have a regulator body 354, an inlet port 356 connected to the regulator body 354, and an outlet port 358 connected to the regulator body 354. An example of a regulator usable with the breathing system is a Victor regulator available from Masthead distributors of Clinton Drive, Houston, Tex.

An inlet pressure gauge 360 can be connected to the inlet port. An outlet pressure gauge 362 can be connected to outlet port to monitor and measure the pressure of the breathing air. A regulator conduit 364 connects from the outlet port to the manifold body 328 and communicates with the chamber 330. The conduits can have an inside diameter ranging from 1 inch to about 3 inches, although the inside diameter of the conduits is dependent upon air flow rates desired through the breathing air conduit.

A pressure relief valve 366 is connected to the regulator body 354, and one pressure relief valve 366 per manifold 90 is typically used. A low-pressure alarm 368 is connected to the inlet port. The alarm 368 provides a signal, or alarm, such as a flashing light or a noise, when the air conduit pressure falls below 500-psi.

F. Example Capacity Determinations for Disclosed System

Figure 7:
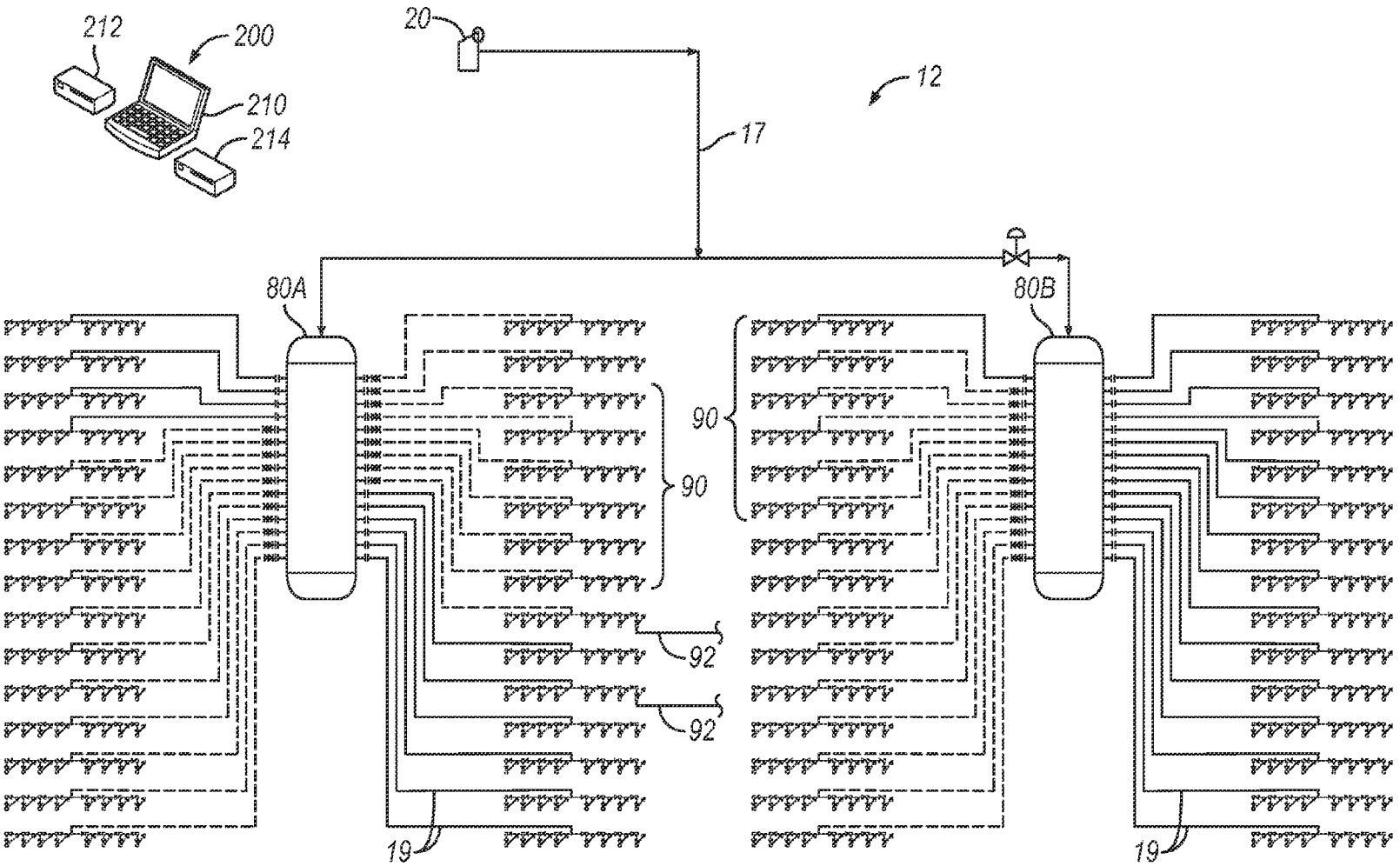
FIG. 7 shows an arrangement of collection pots and manifolds for the disclosed system.

FIG. 7 shows an arrangement of collection pots 80A-B and manifolds 90 for the disclosed system 10. A typical configuration of the system 10 is shown in FIG. 7 (as with FIG. 1 and others) in which one generation assembly 12 (most of which is not shown) feeds the distribution assembly 14. In turn, the distribution assembly 14 has two collection pots 80A-80B and various connected distribution manifolds 90. Various hoses 17 and 19 connect the components of the system 10 together, and other hoses 92 connect to end users.

The lengths and diameters of the connecting hoses 17 and 19 between the assembly 12, pots 80A-B, and manifolds 90 depend on the implementation. In general, an acceptable distance between components and the resulting end pressure produced are governed by the diameter of the hoses 17 and 19 and the related air flow passing through the hoses 17 and 19 to produce a relative pressure drop. The larger the hose diameter, the less pressure drop to occur with the flow and distance. These considerations are taken into account when arranging the components of the system 10 at a worksite.

The arrangement of FIG. 7 is discussed in connection with the capacity and other capabilities of the disclosed system 10. Various numbers of end users can be supported by the system 10 at any given time when particular pressure levels are maintained in the collection pots 80A-80B. The discussion that follows reviews the capacity of the system 10 when pressures of 100-psig and/or 60-psig are maintained in the collection pots 80A-B. Three different cases are discussed below using Pipeflo and Aspen Hysys process simulation software to perform analysis.

In all three cases, the system 10 uses two (2) collection pots 80A-B, even though the system 10 can have one or more pots 80A-B. All the same, use of two pots 80A-B has been done as a typical arrangement. Overall analysis shows that a system configuration (50-ft. of a 2-in. hose 17 for the main feed line and 200-ft. of 2-in. hose 19 for each collection pot 80A-B) allows as many as 277 users to be hooked up to the system 10 at any time.

In a first configuration, for example, the two collection pots 80A-80B are each maintained at pressures of 60-psig and 100-psig, respectively. For this configuration, the compressor 20 delivers a constant supply of 200-acfm of air at a pressure of 125-psig (228.2 lb-moles/hr). The 2-in. hose 17 between the generation assembly 12 and the collection pots 80A-B can be assumed to be 200-ft, which is a minimum length normally used. The ¾-in. hose 17 was assumed at 200-ft., and the ⅜-in. hoses 92 to the end users were assumed to be 250-ft each. The end users connected to the 60-psig pot 80A, were assumed to consume 7-scfm/user, while those end users connected to the 100-psig pots 80B were assumed to consume 6-scfm/user.

With one pot 80A operating at 100-psi and the other pot 80B at 60-psi and using 200 ft. of 2-in. hose 17, analysis indicates that 149 and 128 users, respectively, can be connected via the collection pots 80A-B operating at a minimum pressure of 100-psig and 60-psig, respectively. This analysis considers the pressure drops occurring in the connecting hoses 17 and 19 between the major components.

In a worst case of this arrangement, the 2-in. hose 17 between the generation assembly 12 and each of the collection pots 80A-80B may be 2000 ft., while the other hoses 19 and 92 can be kept the same. In addition, end users connected to the 60-psig pot 80B are assumed to consume 7-scfm/user, while those connected to the 100-psig pot 80A are assumed to consume 6-scfm/user. Under these conditions, the pressure drop in the 2-inch hose 17 limits the system's capacity. The compressor 20 in such a circumstance may work intermittently, as per end user consumption, to give an average flow rate over time that is less than the compressor nominal capacity.

Analysis shows that up to 73 and 61 end users, respectively, can be connected via the collection pots 80A-80B at any one time when operating at a minimum pressure of 100-psig and 60-psig, respectively. The average air flow rate under these conditions will be in the neighborhood of 93.96-acfm (140 lb-m/hr).

In a second configuration, the two collection pot 80A-80B both have pressures maintained at 60-psig. The 2-in. hose 17 between the generation assembly 12 and the collection pots 80A-80B may be 200 ft. to allow for consumption of the full compressor capacity of 200-acfm of air flow. The ¾-in. hose 19 may be 200-ft., and the ⅜-in. individual end user hoses 92 may be 250-ft. each. The end user air consumption is assumed to be 7-scfm/user. Analysis shows that up to 256 end users can be connected via the two collection pots 80A-80B in this configuration.

In another scenario, the collection pots 80A-80B are both at 60-psig, while the 2-in. hose 17 between the generation assembly 12 and the collection pots 80A-80B may be at a maximum length of 2000-ft. Other hose lengths are same as above (i.e. the ¾-in. hose 19 is assumed at 200-ft., and the ⅜-in. end user hoses 92 are assumed at 250-ft. each). The end user air consumption is assumed to be 7-scfm/user. Analysis shows that up to 186 end users can be connected via the two collection pots 80A-80B in this configuration, with an average compressed air flow of 208 lb-m/hr. Due to the 60-psig in the collection pots 80A-B, the end user hose (⅜-in.) 92 is limiting and should not extend beyond 100-ft. in length. However, lower pressure at collection pots 80A-B allows for a longer 2-in. hose 17 can run (e.g., 950 ft.).

In a third configuration, the two collection pots 80A-B are both maintained at 100-psig. The 2-in. hose 17 between the generation assembly 12 and the collection pots 80A-B is assumed at a minimum length of 200-ft. Meanwhile, the ¾-in. hose 19 is assumed at 200-ft., and the ⅜-in. end user hoses 92 are assumed at 250-ft. each. Air consumption is assumed to be 6-scfm/user. Analysis shows that 298 end users can be connected to the two collection pots 80A-80B.

In a worst case, the 2-in. hose 17 between the generation assembly 12 and the collection pots 80A-B is assumed at the maximum length of 2000-ft. The ¾-in. hose 19 is assumed at 200-ft., and the ⅜-in. end user hoses 92 are assumed at 250-ft. each. With air consumption at 6-scfm/user, analysis suggests that when running the system to maintain 100-psig in the collection pots 80A-B with the hose 17 length of 2000-ft., the average air flow will be reduced to approximately 93.96-acfm (140 lb-m/hr).

As the 2-inch hoses 17 feeding the collection pots 80A-B increase in length, they become limiting on the air flow, if the pots 80A-B must be maintained at 100-psig. Therefore, if a long distance is needed between the generation assembly 12 and pots 80A-80B, the outlet (at the generation assembly 12) can be increased to 3-in. or 4-in. coming out from the generation assembly 12 for the main feed line hoses 17 and can be increased to 3-in. branches feeding from the dry tank 70 to the collection pots 80A-B. This will allow the use of long hoses while still operating the compressor 20 at its full capacity.

An alternative to using a larger diameter hose 17 to feed the collection pots 80A-B when these are a long distance away from the trailer is to use a type of respirator that allows the pots 80A-B to operate at 60 instead of 100-psig. However, the lower pot pressure can limit the maximum length of ⅜-inch hoses that can be used.

In the system 10, the length of ¼-in. hose 19 is the least limiting component and takes the least pressure drop. Accordingly, lengths of ¼-in. hose 19 can be added between the pots 80A-80B and the supply manifolds 90 to reach the end users. These hoses can be used instead of the need to use a longer 2-in. hose 17 from the generation assembly 12 to the collection pots 80A-80B.

During operation, the number of users may remain constant so that the system operates under steady-state conditions. However, in many circumstances, the number of users and their individual air demand rates do change over time as the system operates. The system 10 is designed to operate effectively under such transient conditions, such as when users hook-up and unhook.

G. Example Reserve Supply

Figure 8:
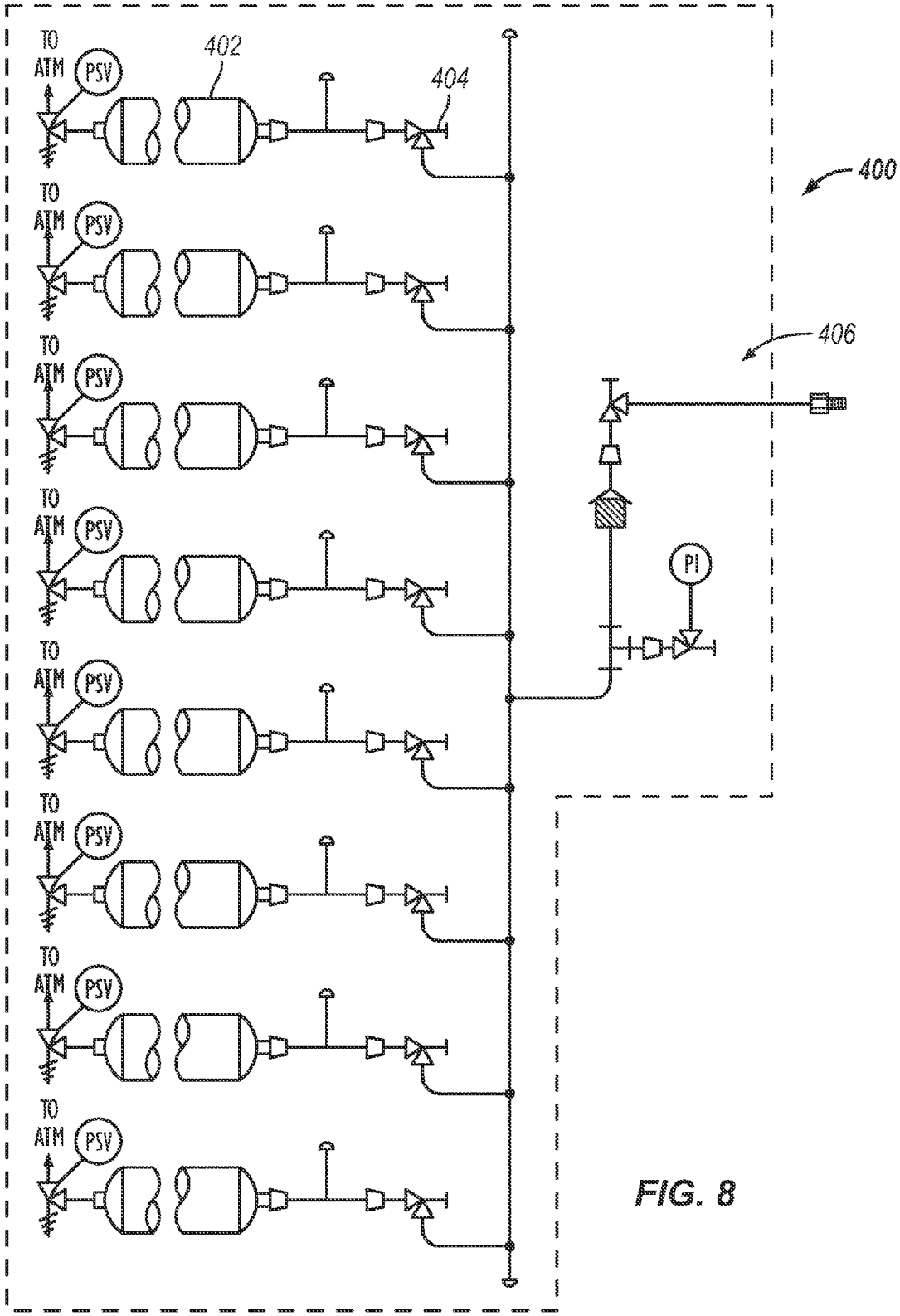
FIG. 8 illustrates a reserve supply for the disclosed system.

FIG. 8 illustrates a reserve supply 400 for connection to the disclosed system 10 as a back-up high-pressure air supply. The reserve supply 400 includes a number (8) of cylinders or tubes 402 that can mount on a bulk tube trailer. Each tube 402 can hold breathable air at 3000-psig. Angle valves 404 connect the tubes 402 to an outlet 406, which can connect to the disclosed system 10 of the present disclosure using a ¼-inch high-pressure hose (408).

Details of a distribution manifold 90 as used herein as well as other components for a breathing system are disclosed in U.S. Pat. No. 7,347,204, entitled "Breathing Air System for a Facility," which is incorporated herein by reference in its entirety. If not already discussed, preferred hoses, sizes, connections, capacities, pressures, valves, and other details are disclosed in the Figures of the incorporated provisional application and are incorporated into the specification as well. Yet, one skilled in the art having the benefit of the present disclosure will understand that details of hoses, sizes, connection, capacities, etc. will depend on the particular implementation so such details are not intended to be limiting to the present invention.

The foregoing description of preferred and other embodiments is not intended to limit or restrict the scope or applicability of the inventive concepts conceived of by the Applicants. It will be appreciated with the benefit of the present disclosure that features described above in accordance with any embodiment or aspect of the disclosed subject matter can be utilized, either alone or in combination, with any other described feature, in any other embodiment or aspect of the disclosed subject matter.

In exchange for disclosing the inventive concepts contained herein, the Applicants desire all patent rights afforded by the appended claims. Therefore, it is intended that the appended claims include all modifications and alterations to the full extent that they come within the scope of the following claims or the equivalents thereof.

What is claimed is:

1. A breathing air system, comprising:

a compressor assembly generating intake air;

a first power subsystem supplying power to the compressor assembly;

a filtration assembly in communication with the compressor assembly and filtering the intake air;

a second power subsystem supplying power to the filtration assembly;

one or more collection pots in communication with the filtration assembly and collecting the intake air;

one or more distribution manifolds in communication with the one or more collection pots and distributing the intake air to one or more breathing hoses;

one or more wireless sensors in communication with the intake air from the filtration assembly and continuously monitoring the intake air for one or more parameters;

a monitoring unit in wireless communication with the one or more wireless sensors and obtaining readings of the one or more parameters monitored by the one or more wireless sensors; and a third power subsystem supplying power to the monitoring unit;

wherein each of the power subsystems is independently operable.

2. The system of claim 1, wherein the filtration assembly comprises at least one of:

a drying component drying the intake air;

a catalytic converter converting carbon monoxide in the intake air to carbon dioxide; and a charcoal filter filtering the intake air.

3. The system of claim 1, wherein the one or more wireless sensors comprise at least one of:

a flow meter in communication with the intake air to the one or more collection pots and measuring flow of the intake air;

one or more pressure sensors measuring pressure of the intake air at the one or more collection pots; and one or more temperature sensors measuring temperature of the intake air at the one or more collection pots.

4. The system of claim 1, further comprising a switch-over assembly in communication with intake air from a stored air source, the switch-over assembly selectively communicating the intake air from the stored air source to the one or more collection pots.

5. The system of claim 4, wherein the switch-over assembly communicates the intake air from the stored air source automatically in response to the one or more parameters indicating at least one contaminant in the intake air from the compressor assembly and/or indicating pressure of the intake air from the compressor assembly falling below a threshold.

6. The system of claim 4, wherein the switch-over assembly comprises:

a pressure sensor measuring the pressure of the intake air from the compressor assembly;

a solenoid activated in response to the pressure sensor; and a controllable gate valve opening with the activation of the solenoid.

7. The system of claim 4, wherein the one or more wireless sensors comprise a contaminant detection sensor in communication in line with the intake air communicated to the one or more collection pots and measuring the intake air for presence of one or more contaminants.

8. The system of claim 7, wherein the contaminant detection sensor comprises a photoionization detector detecting the one or more contaminants in an air stream of the intake air communicated past the photoionization detector.

9. The system of claim 7, wherein the contaminant detection sensor comprises a pressure control valve in communication with a vent, the pressure control valve venting the intake air to the vent automatically in response to the presence of at least one of the one or more contaminants in the intake air.

10. The system of claim 7, wherein the contaminant detection sensor comprises a controller generating an alarm condition automatically in response to the presence of at least one of the one or more contaminants in the intake air.

11. The system of claim 7, wherein the contaminant detection sensor closes communication of the intake air from the compressor assembly to the one or more collection pots automatically in response to the presence of at least one of the one or more contaminants in the intake air.

12. The system of claim 11, wherein the contaminant detection sensor comprises a solenoid and a controllable gate valve, the solenoid activating the controllable gate valve to close communication of the intake air from the compressor assembly.

13. The system of claim 1, wherein the one or more wireless sensors comprise a contaminant detection sensor in communication in line with the intake air communicated to the one or more collection pots and measuring the intake air for presence of one or more contaminants.

14. The system of claim 13, wherein the contaminant detection sensor comprises a photoionization detector detecting the one or more contaminants in an air stream of the intake air communicated past the photoionization detector.

15. The system of claim 13, wherein the contaminant detection sensor comprises a pressure control valve in communication with a vent, the pressure control valve venting the intake air to the vent automatically in response to the presence of at least one of the one or more contaminants in the intake air.

16. The system of claim 13, wherein the contaminant detection sensor comprises a controller generating an alarm condition automatically in response to the presence of at least one of the one or more contaminants in the intake air.

17. The system of claim 16, wherein the controller communicates the alarm condition wirelessly to the monitoring unit.

18. The system of claim 16, wherein the controller activates a local alarm in response to the alarm condition.

19. The system of claim 13, wherein the contaminant detection sensor closes communication of the intake air from the compressor assembly to the one or more collection pots automatically in response to the presence of at least one of the one or more contaminants in the intake air.

20. The system of claim 19, wherein the contaminant detection sensor comprises a solenoid and a controllable gate valve, the solenoid activating the controllable gate valve to close communication of the intake air from the compressor assembly.

21. The system of claim 1, wherein the system is coupled to a stored air source providing intake air for the system, the system comprising:

a compressor of the compressor assembly operable as the ambient air source to produce the intake air; and a switch-over assembly selectively preventing the intake air from an ambient air source from communicating to the one or more collection pots and selectively permitting the intake air from the stored air source to communicate with the one or more collection pots, wherein the switch-over assembly is automatically switched from communicating the intake air of the ambient air source to communicating the intake air of the stored air source in response to at least one of the monitored parameters.

22. The system of claim 21, wherein the monitoring unit automatically activates the switch-over assembly in response to pressure of the intake air from the ambient air source falling below a threshold.

23. A breathing air system, comprising:

one or more collection pots in communication with intake air from an ambient air source;

one or more distribution manifolds in communication with the one or more collection pots and distributing the intake air to one or more breathing hoses;

one or more wireless sensors in communication with the intake air from the ambient source and continuously monitoring the intake air for one or more parameters; and a monitoring unit in wireless communication with the one or more wireless sensors and obtaining readings of the one or more parameters monitored by the one or more wireless sensors, the one or more wireless sensors comprising a contaminant detection sensor in communication in line with the intake air communicated to the one or more collection pots and measuring the intake air for presence of one or more contaminants, the contaminant detection sensor comprising a pressure control valve in communication with a vent, the pressure control valve venting the intake air to the vent automatically in response to the presence of at least one of the one or more contaminants in the intake air.

24. The system of claim 23, wherein the one or more wireless sensors further comprise at least one of:

a flow meter in communication with the intake air to the one or more collection pots and measuring flow of the intake air;

one or more pressure sensors measuring pressure of the intake air at the one or more collection pots; and one or more temperature sensors measuring temperature of the intake air at the one or more collection pots.

25. The system of claim 23, further comprising a switch-over assembly in communication with intake air from a stored air source for intake air, the switch-over assembly selectively communicating the intake air from the stored air source to the one or more collection pots.

26. The system of claim 25, wherein the switch-over assembly communicates the intake air from the stored air source automatically in response to at least one of the monitored parameters indicating the at least one contaminant in the intake air and/or indicating pressure of the intake air from the ambient air source falling below a threshold.

27. The system of claim 25, wherein the switch-over assembly comprises:

a pressure sensor measuring pressure of the intake air from the ambient air source;

a solenoid activated in response to the pressure sensor; and a controllable gate valve opening with the activation of the solenoid.

28. The system of claim 23, wherein the contaminant detection sensor comprises a photoionization detector detecting the one or more contaminants in an air stream of the intake air communicated past the photoionization detector.

29. The system of claim 23, wherein the contaminant detection sensor comprises a controller generating an alarm condition automatically in response to the presence of the at least one contaminant in the intake air.

30. The system of claim 29, wherein the controller communicates the alarm condition wirelessly to the monitoring unit.

31. The system of claim 29, wherein the controller activates a local alarm in response to the alarm condition.

32. The system of claim 23, wherein the contaminant detection sensor closes communication of the intake air from the ambient air source to the one or more collection pots automatically in response to the presence of the at least one contaminant in the intake air.

33. The system of claim 32, wherein the contaminant detection sensor comprises a solenoid and a controllable gate valve, the solenoid activating the controllable gate valve to close communication of the intake air from the ambient air source.

34. The system of claim 23, further comprising:

a compressor assembly generating the intake air as the ambient air source;

a first power subsystem supplying power to the compressor assembly;

a filtration assembly in communication with the compressor assembly and filtering the intake air;

a second power subsystem supplying power to the filtration assembly; and a third power subsystem supplying power to the monitoring unit.

35. The system of claim 34, wherein each of the power subsystems is independently operable.

36. The system of claim 23, wherein the monitoring unit obtains the readings periodically and stores the obtained readings in memory.

37. The system of claim 23, further comprising at least one of:

a drying component drying the intake air;

a catalytic converter converting carbon monoxide in the intake air to carbon dioxide; and a charcoal filter filtering the intake air.

38. The system of claim 37, wherein the monitoring unit automatically activates the switch-over assembly in response to pressure of the intake air from the ambient air source falling below a threshold.

39. The system of claim 23, wherein the system is coupled to a stored air source of the intake air for the system, the system comprising:

a compressor operable as the ambient air source to produce the intake air for the system; and a switch-over assembly disposed in selective communication with the ambient air source and the stored air source, wherein the switch-over assembly is automatically switched from communicating the intake air of the ambient air source to communicating the intake air of the stored air source in response to at least one of the monitored parameters.

40. The system of claim 39, wherein the one or more wireless sensors comprise a flow meter in communication with the intake air to the one or more collection pots and measuring flow of the intake air.

41. The system of claim 39, wherein the one or more wireless sensors comprise one or more pressure sensors measuring pressure of the intake air at the one or more collection pots.

42. The system of claim 39, wherein the one or more wireless sensors comprise one or more temperature sensors measuring temperature of the intake air at the one or more collection pots.

43. The system of claim 39, wherein the switch-over assembly communicates the intake air from the stored air source automatically in response to the at least one monitored parameter indicating at least one contaminant in the intake air from the ambient air source.

44. The system of claim 39, wherein the switch-over assembly communicates the intake air from the stored air source automatically in response to the at least one monitored parameter indicating pressure of the intake air from the ambient air source falling below a threshold.

45. The system of claim 44, wherein the switch-over assembly comprises:

a pressure sensor measuring the pressure of the intake air from the ambient air source;

a solenoid activated in response to the pressure sensor; and a controllable gate valve opening with the activation of the solenoid.

* * * * *